United States Patent [19]

Becker

[11] Patent Number: 4,478,023

[45] Date of Patent: Oct. 23, 1984

[54] UNIVERSAL FOUR FLAP OPENER

[75] Inventor: Michael L. Becker, Akron, Ohio

[73] Assignee: Figgie International, Inc., Willoughby, Ohio

[21] Appl. No.: 373,238

[22] Filed: Apr. 29, 1982

[51] Int. Cl.[3] ..... B65B 43/49

[52] U.S. Cl. ..... 53/382

[58] Field of Search ..... 414/411; 53/382, 75, 53/381, 492

[56] References Cited

U.S. PATENT DOCUMENTS 3,224,165 12/1965 Nigrelli et al. ..... 53/382

3,852,942 12/1974 Johnson et al. ..... 53/382

4,160,351 7/1979 Mais et al. ..... 53/382 X

*Primary Examiner*—Robert G. Sheridan

*Attorney, Agent, or Firm*—Oldham, Oldham, Hudak & Weber Co.

[57] ABSTRACT

Apparatus for automatically receiving and opening the four flaps of a cardboard case or the like. The invention includes a conveyor system for transporting cases in spaced relationship with each other past a pair of vacuum-actuated hinged shoes which engage and partially open the side flaps and direct the same into a plow. The plow completes the opening of the side flaps. A pair of brushes, having common drive, but opposite rotation, are adapted for opening the front and rear flaps. A fabric belt engages and holds the front flap down, while a rotating arcuate member makes hold-down contact with the rear flap. The apparatus is adjustable to accommodate cases and flaps of varying dimensions.

16 Claims, 14 Drawing Figures

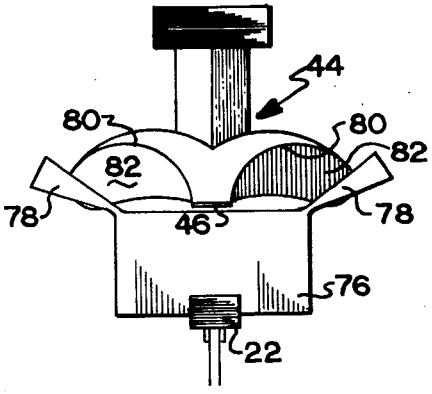
FIG. 3D
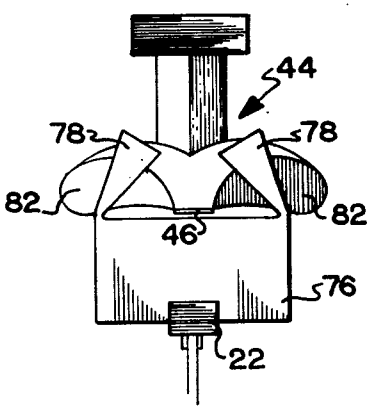
FIG. 3C
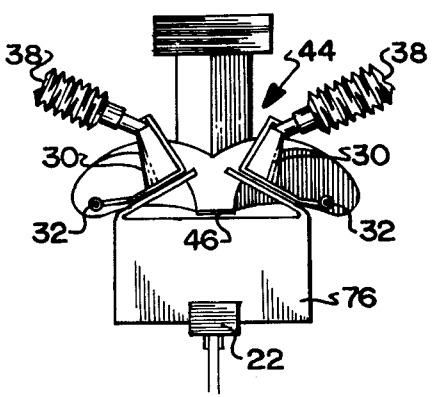
FIG. 3B
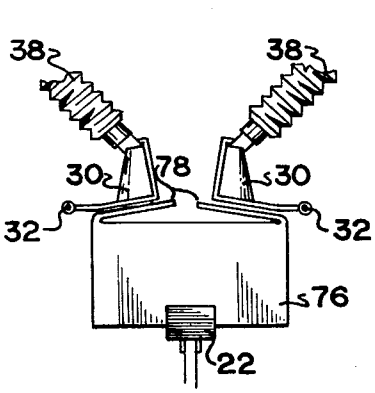
FIG. 3A
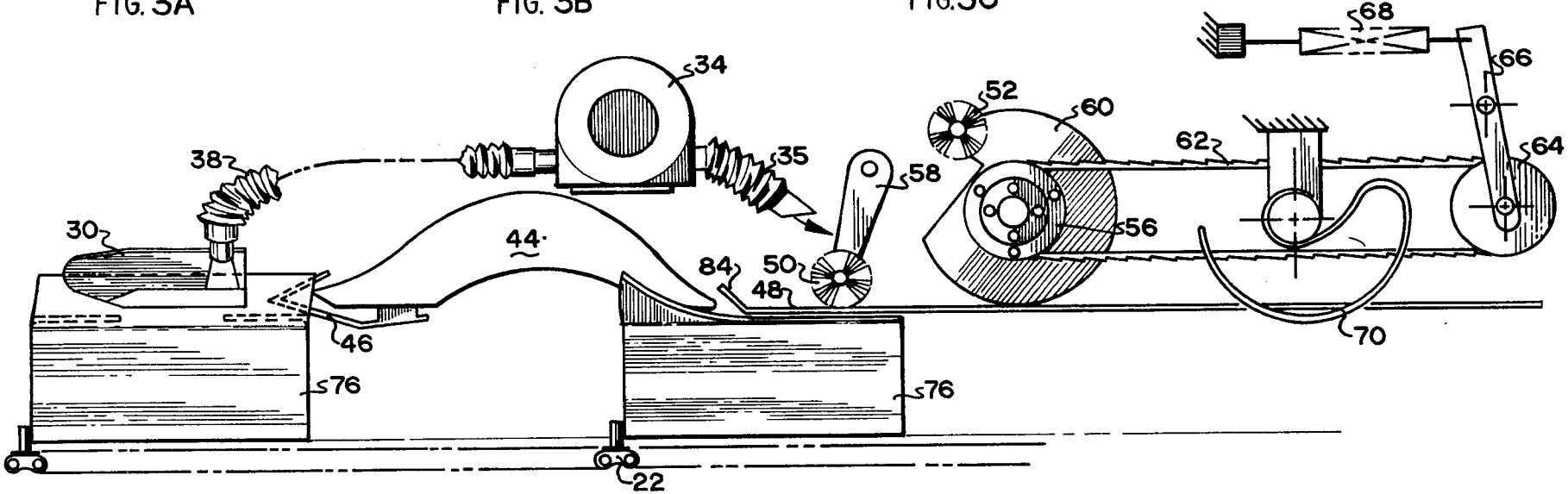

UNIVERSAL FOUR FLAP OPENER

TECHNICAL FIELD

The invention herein resides in the art of article handling equipment. More particularly the invention relates to an apparatus for opening the four flaps of a case containing bottles or the like such that the bottles may be accessed and removed by an uncaser. The invention is particularly adapted for use in the bottling industry.

BACKGROUND ART

In many industries, and particularly the beverage industry, reusable bottles are employed. The bottler receives used empty bottles in cases, typically enclosed at the top by four flaps. Before the bottles may be removed from the cases, the flaps must be opened. Presently, there are machines for removing bottles from the cases, which machines can operate at extremely high speeds. However, the problem of opening the four flaps of each case to access the bottles is not a simple one. As is readily apparent, the four flaps typically comprise two pairs of two flaps each, the pairs being orthogonal to each other.

Flap openers have been known in the art, but they are presently of a rudimentary nature and not adapted for high speed operation. Further, known flap openers are neither positive acting nor reliable in operation. Often, cases are damaged or destroyed by virtue of flaps torn by the flap opening apparatus. Further, the known flap openers are given to frequently failing to open a flap, such failure resulting in an inability of the uncaser to make access to the bottles. Yet further, known flap openers are difficult to adjust to accommodate various sizes of cases.

DISCLOSURE OF INVENTION

In light of the foregoing, it is an object of the instant invention to provide a flap opener which, while being capable of operating at high speeds, has safeguards for preventing damage to the cases.

In accordance with another aspect of the invention there is presented a flap opener which has positive acting side flap openers at a first stage.

Another aspect of the invention is the provision of a flap opener which has positive acting front and rear flap openers at a second stage.

A further aspect of the invention is the provision of a flap opener which is readily adjustable for accommodating various sizes of boxes.

Still a further aspect of the invention is the provision of a flap opener which is capable of high speed operation to accommodate present day uncasers.

Still an additional aspect of the invention is the provision of a flap opener which is cost effective, reliable, and readily constructed utilizing state-of-the-art components.

The foregoing and other aspects of the invention which will become apparent as the detailed description proceeds are achieved by a flap opener, comprising: an input conveyor; a pair of vacuum-actuated side flap openers positioned along said conveyor; a side flap spreader positioned along said conveyor after said vacuum-actuated side flap openers; and a pair of brushes in common driven interconnection, rotatably mounted above said conveyor beyond said spreader, said brushes adapted for opening engagement with front and rear flaps of a container.

BRIEF DESCRIPTION OF DRAWINGS

For a complete understanding of the objects, techniques, and structure of the invention reference should be had to the following detailed description and accompanying drawings wherein:

FIG. 3 comprising FIGS. 3A–3D, is an illustrative front elevational view of a case passing through the side flap opening stage of the invention;

FIG. 4 is an illustrative view of the flap opening stages of the invention;

FIG. 5, comprising

BEST MODE FOR CARRYING OUT THE INVENTION

Figure 1:
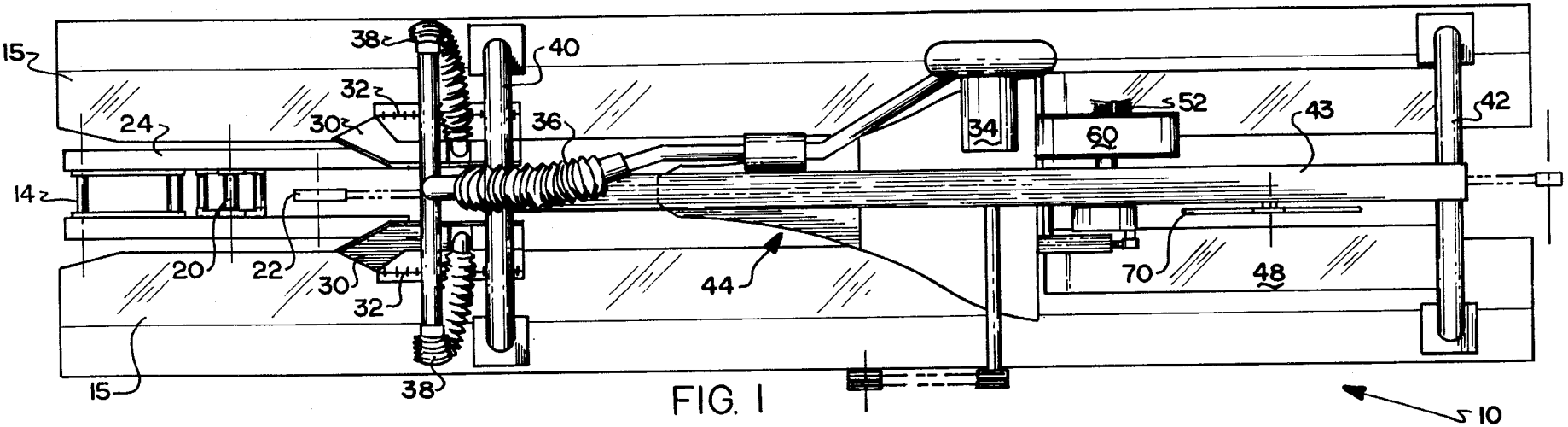
FIG. 1 is a top plan schematic view of the four flap opener of the invention.
Figure 2:
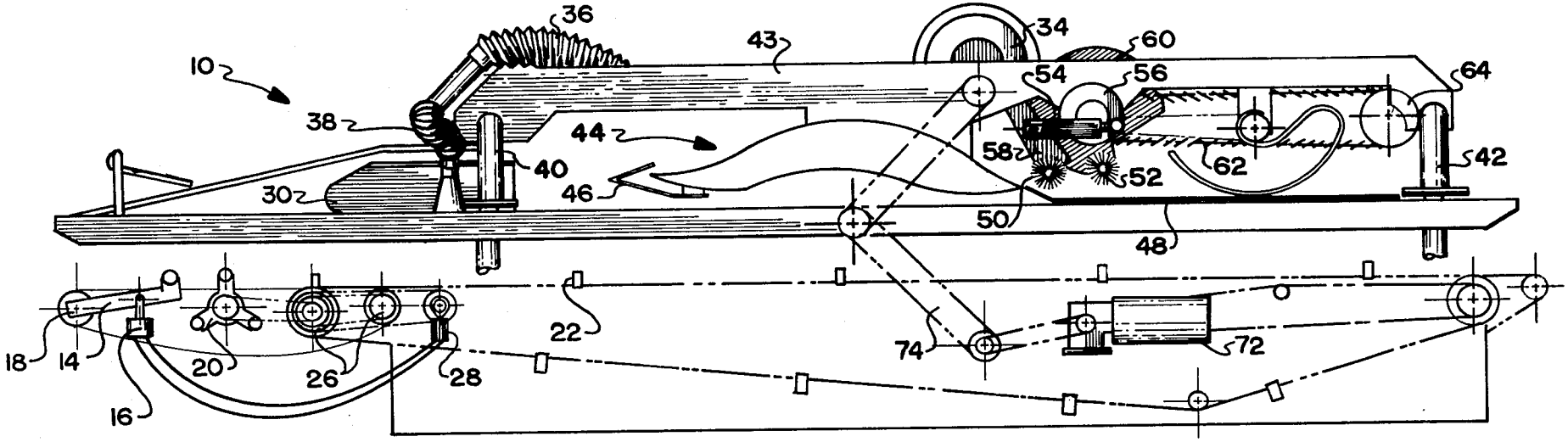
FIG. 2 is a side schematic view of the four flap opener of the invention.

Referring now to the drawings and more particularly FIGS. 1 and 2, it can be seen that a universal flap opener made according to the teachings of the invention is designated generally by the numeral 10. An in feed 12 is provided with a tapered opening for receiving cases of empty bottles. The tapered opening of the in feed 12 allows for proper alignment of the cases onto the conveyor system of the assembly 10. A gate 14 blocks the incoming cases until appropriately actuated by an air cylinder 16. As illustrated, the gate 14 is hinged or pivotally restricted as at 18.

When the gate 14 drops, a table top chain 24 urges the case toward the star wheel 20, which is continuously running and has three tines thereon. The star wheel 20 is timed with a lug chain 22 to achieve appropriate spacing between the incoming cases which are fed to the remainder of the structure 10. As illustrated, sprockets 26 interconnect and drive the star wheel 20, lug chain 22, and table top chain 24. A double solenoid valve 28 is connected to a cam shaft driven by the sprockets 26 for effecting proper timing for the dropping and raising of the gate 14. This timing allows for spaced introduction of cases to the star wheel 20 and lug chain 22 and the interruption of the flow of cases at any of the three tines of the star wheel.

As shown in FIGS. 1 and 2, the lugs of the lug chain 22 are operative for contacting the bottom trailing edge of a case and urging the same toward a pair of shoes 30, which, as will be discussed hereinafter, are flared slightly upwardly to accommodate and receive the side flaps of the incoming case. The shoes 30 are hingedly connected to the case guide 15 as at 32. A vacuum source 34 feeds through a flex tubing 36 to communicate a vacuum through flex tubing 38, which vacuum then communicates through slots in the bottoms of the shoes 30 to suck the side flaps into contact with the bottoms of the shoes 30. As will be discussed hereinafter, the flex tubing 38 is extensible and collapsible such that, when the vacuum seals against the side flaps, the tubing 38 collapses and folds the shoes 30 back over the hinges 32 to lift the side flaps, thus opening the same.

As will be discussed hereinafter, the side flaps, opened by the shoes 30, are fed to a plow assembly 44 which, as shown in FIG. 2, has a floating nose or shoe 46 at the front thereof, angled upwardly, to knock down the rear flap and to avoid spearing or ripping the same. With the shoe 46 floating and being so angled, the trailing rear flap cannot be speared, but depending upon the posture of the rear flap when contacted with the shoe 46, the flap is either closed onto the container or opened from the container. As will be discussed hereinafter, the leading edge of the plow 44 receives the opened side flaps and the diverging edges of the plow 44 further fold the side flaps open and feed them directly to the side flap trap and guides 48. The side flaps then travel between the guide 48 and the top of the case guide 15, being then permanently opened. It should be noted at this time that the plow assembly 44, as well as the blower motor 34, tubing 36,38, and other apparatus to be discussed hereinafter, are maintained above the base and conveyor of the assembly 10 by means of head support members 40,42, and the interconnecting beam 43.

With the side flaps open, attention is then given to opening the front (leading) flap and the rear (trailing) flap. A brush 52 is operative for opening the front flap, in a manner to be discussed hereinafter, while the brush 50 is operative for opening the rear flap. It will be appreciated that in the preferred embodiment of the invention, there are a pair of brushes 50 and a pair of brushes 52, although a single, elongated brush would suffice.

The brushes 50,52 are maintained in adjustable relationship with each other, and are driven by a common drive assembly. The brush 52 is maintained on a wheel 60, which wheel is driven by a shaft. The shaft driving the wheel 60 is connected through an adjusting hub 56 to drive, through a crank arm 54, the pivoted tracking arm 58 which receives the brush 50. The brushes 50,52 rotate in a manner to be discussed hereinafter, by a common drive off of the same chain drive which effects rotation of the wheel 60. Suffice it to say at this time that the adjusting hub 56 allows for appropriate spacing or timing between the actions of the brushes 50,52 to accommodate various lengths of cases.

The rotating brush 52 is moved by the wheel 60 into contacting engagement with the front flap 52 with the bristles of the brush contacting the cut flap edge and urging the same upward and into a fibrous link chain belt 62. The belt 62 continues the opening of the front flap by engaging the same and maintains the front flap open as the case continues its movement under the urging of the lug chain 22. As shown, the belt 62 is driven by a pulley 64, again driven by sprocket-chain interconnection with the same drive as drives the wheel 60.

The rear flap is opened by means of the rotating brush 50, moved by the pivoted tracking arm 58 under control of the crank arm 54. Again, the rotating brush 50 lifts the cut leading edge of the rear flap and urges the same open to lay flat behind the case, in a plane parallel to the case top. To keep the rear flap down, a rear flap retainer 70, to be discussed hereinafter, rotates about an axis, under common drive with the wheel 60, to keep the rear flap from folding upwardly.

As illustrated, a single motor 72 is operative for driving all pulleys, chains, and the like for effecting operation of the system. Such drive includes the drive of the lug chain 22, table top chain 24, rotation of the star wheel 20, and actuation of the elements just described as driven in common with the wheel 60. An adjustable chain drive 74 is provided to communicate power transmission from the base, maintaining the motor 72 and conveyor system, to the head assembly maintaining the flap opening apparatus. It will be appreciated that the head assembly is vertically adjustable with respect to the base to accommodate various case depths or heights. Of course, such adjustment is now known in the art.

With reference now to FIG. 3, comprising FIGS. 3A–3D, it can be seen that the lug chain 22 urges a carton or case 76 toward the vacuum-actuated shoes 30. The shoes 30 have slots in the bottoms thereof which communicate a vacuum through the collapsible and extensible hoses 38 as discussed above. When the flaps are drawn against the base of the shoes 30 by the vacuum, the vacuum seals and the hoses 38 collapse, drawing the shoes 30 open as against the hinges 32, as illustrated. The lug chain 22 continues movement of the case 76 to a point where the side flaps 78 engage the arcuate diverging edges 80 of the plow assembly 44. As the case 76 continues to move, the diverging edges spread the side flaps 78 open as illustrated. Contact is, of course, also made by the arcuate diverging surfaces 82 of the plow 44, such surfaces being defined by the edges 80. As discussed above, the plow 44 opens the side flaps 78 into a purely horizontal posture, at which time they are fed directly under the side flap trap and guides 48.

With brief reference to FIG. 4, it can be seen, in diagrammatic view, how the cases 76 continue along through the system 10. It should also be noted at this point that the exhaust of the vacuum source 34 is provided as through a flexible hose 35 as a blower, exhausting gusts of air into the operational area of the brushes 50,52, and into the case 76. The air blown into the case 76 has the tendency to lift the front and rear flaps from the box. The air assists in folding the rear flap over and lifting the front flap into the belt 62.

It should also be noted with respect to FIG. 4, that the rear flap retainer 70 is of a semicircular arcuate nature, again being rotatable counterclockwise, and in proper timing with the lug chain 22 to make hold-down contact with the rear flap of the case 76. It should further be noted that the pulley wheel 64, driving the fabric belt 62, is pivotally connected as by a pivot arm 66 which is biased by a spring 68. This biasing allows the fabric belt 62 to be flexible such that it can deflect as it grasps the cut edge of the front flap which has been opened by the brush 52. This action will be better seen in FIG. 5. With final reference to FIG. 4, it should also be noted that the side flap guide or trap 48 has an uplifted lip 84 which communicates with the end of the plow 44 for receiving the side flaps as discussed above.

Figure 5A:
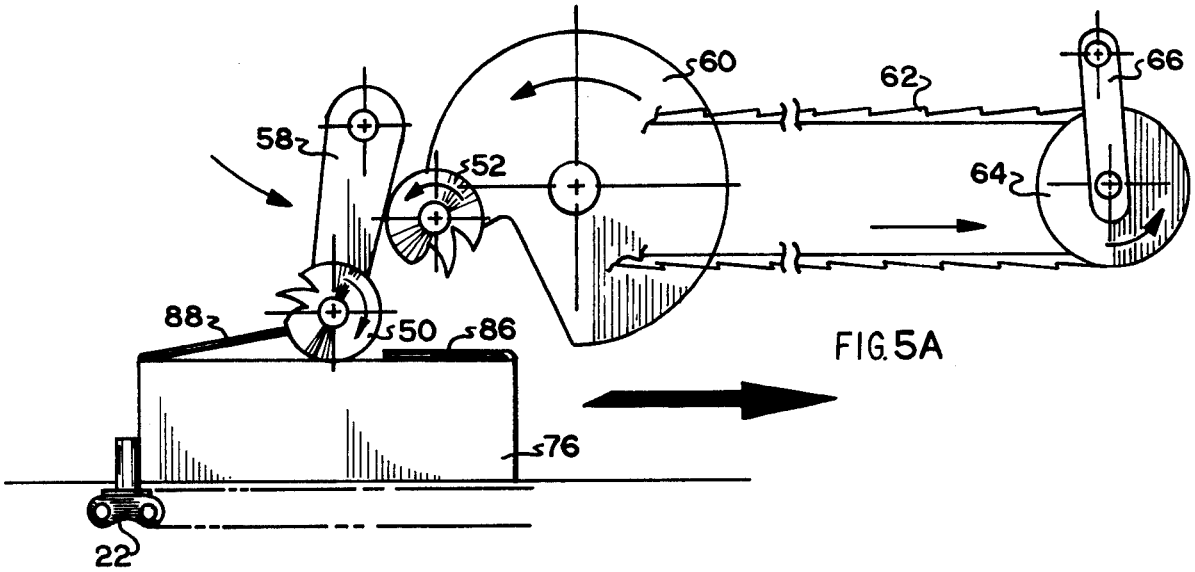
FIGS. 5A–5C, is an illustrative view of the front and rear flap openers incorporated in the invention.
Figure 5B:
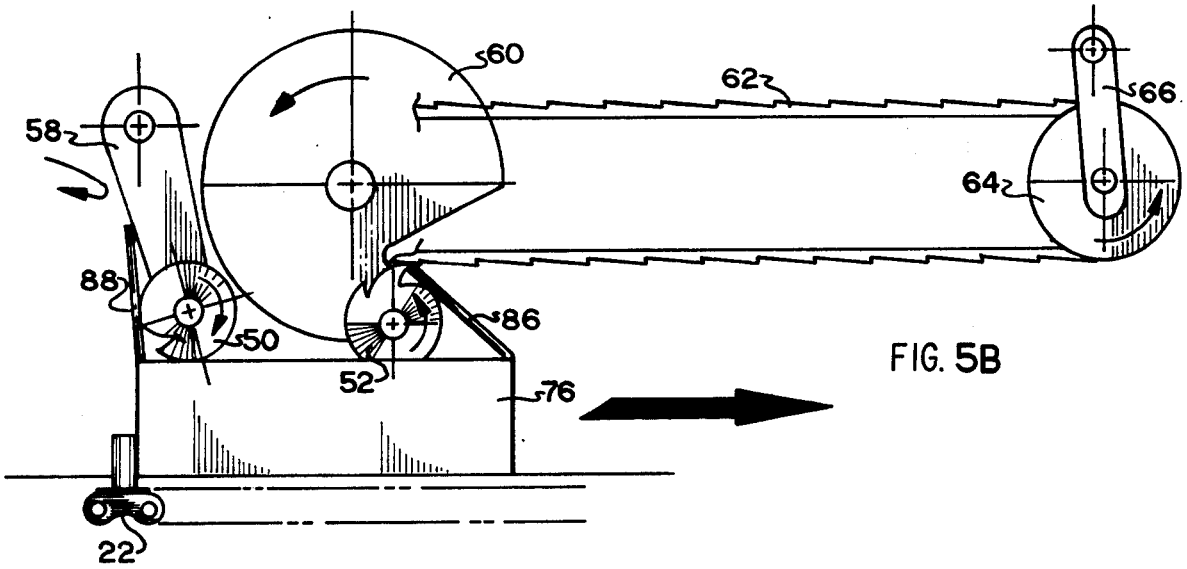
Figure 5C:
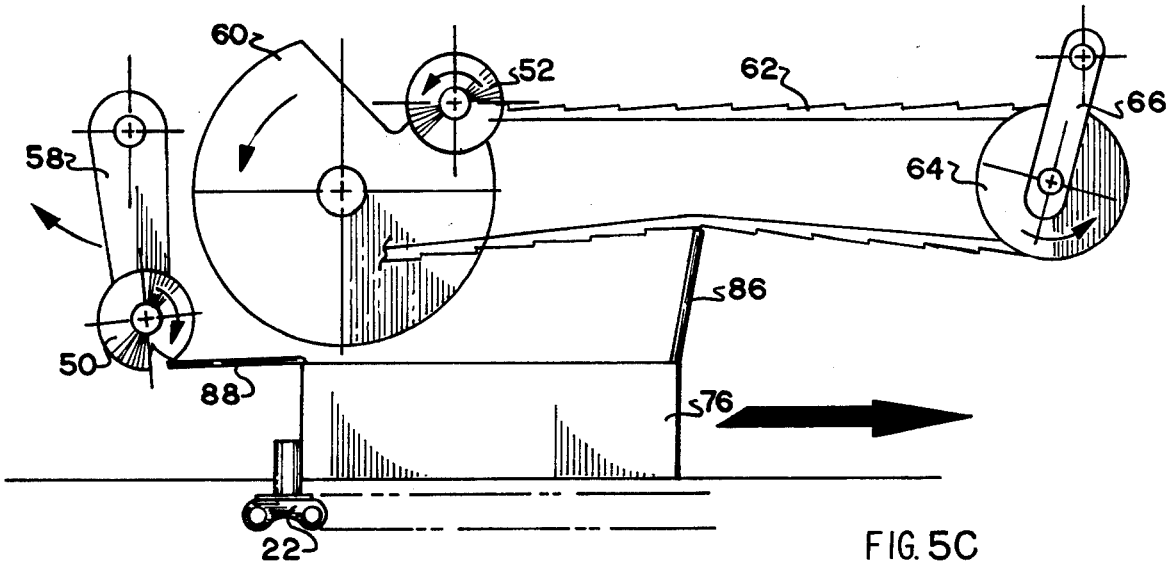

With reference now to FIG. 5, the operation of the brushes 52,50 to respectively open the front and rear flaps 86,88 of the case 76 may be seen. As viewed in FIG. 5, the wheel 60 rotates in a counterclockwise direction, as does the associated brush 52. The brush 50, on the tracking arm 58, rotates counterclockwise, while the tracking arm 58 moves in pendulum fashion, first counterclockwise, then clockwise. As can be seen in FIG. 5, the timing between the contacting engagements of the brushes 50,52 must be set as a function of the length of the cases 76 as well as the flap length, such adjustment to be discussed further hereinafter. As shown, as the case enters the operational area of the front and rear flap openers, the rotating brush 50 makes contacting engagement with the cut edge of the rear flap 88 and begins to lift the same. While lifting, the crank arm 54 causes the brush 50 to pivot via the tracking arm 58 in the direction of the movement of the case 76. The brush continues to rotate, and continues to open the flap 88. Finally, the elements 54,58 allow the brush 50 to swing back against the direction of the movement of the case 76 to complete the opening of the rear flap 88.

Concurrent with the operation of the brush 50, the wheel 60 causes the rotating brush 52 to engage the cut edge of the front flap 86. The brush then lifts the front flap 86 as shown in FIG. 5B to the point where the flap makes contact with the fabric belt 62. The teeth of the belt 62 engage the flap 86 and move the same into a totally open position. It should be noted in FIG. 5 that the belt 62 deflects, moving the pulley 64 and the pivot arm 66 against the biasing of the spring 68 (shown in FIG. 4). The belt 62 maintains the front flap 86 open, while the rear flap retainer 70 (FIG. 4) holds the rear flap 88 open, such that the case 76 may then be fed to an automatic uncaser which makes access to the interior of the case, removing the bottles therefrom.

Figure 6:
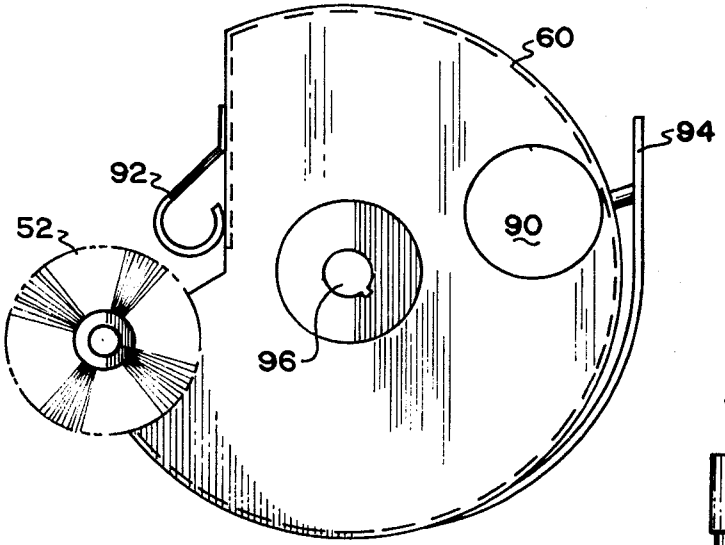
FIG. 6 is a front elevational view of the front flap opener of the invention.

Attention will now be given to certain of the specifics of the elements of the invention just described. With reference now to FIG. 6, it can be seen that the wheel 60, rotatably receiving the brush 52, includes a hole 90 therein for allowing service personnel to make access to the inner portion of the wheel 60 for maintaining the sprockets, chains, and the like received therein. It will be appreciated, as discussed above, that a number of elements are driven in common with the wheel 60, the sprockets for the necessary chain drive being maintained within the wheel 60. It will also be noted with respect to FIG. 6, that a deflection loop 92 may be provided on the wheel 60 for preventing the front flap 86 from being caught by the wheel in cases where the front flap is of excessive length. The loop 92 deflects the front flap away from the wheel and prevents it from becoming crumpled by the wheel. For the same purpose, a control deflector 94, of plastic or the like, is provided about a portion of the wheel 60, for deflecting the rear flap where the rear flap is excessively short. This deflector 94 prevents the short rear flaps from being caught by the belt 62. Finally, it will be noted that the wheel 60 has an axial hole 96 therein for receiving a shaft in keyed engagement.

Figure 7:
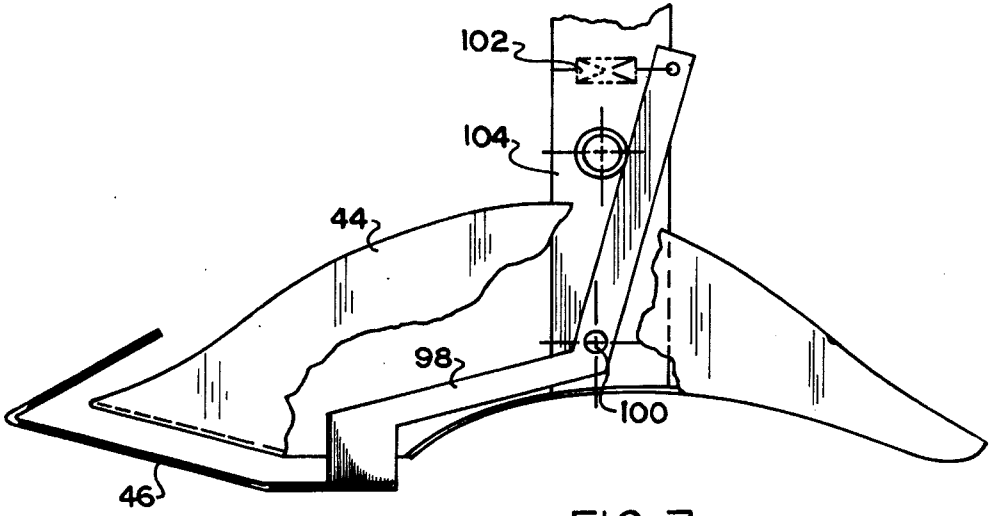
FIG. 7 is a partial sectional view of the plow or side flap spreader of the invention.

The nose of the plow assembly 44 is shown in detail in FIG. 7. As discussed above, the plow includes a floating shoe 46, which floats by means of interconnection with a shoe arm 98 which is pivotable as at 100. The shoe arm 98 is biased as by a spring 102, such spring being affixed to a support beam 104, which beam supports the plow 44 as by interconnection with the beam 43. It will be appreciated that the upward incline of the floating shoe 46 allows it to ride up over an incoming rear flap and to deflect the flap either downwardly or upwardly in a manner to open the same. The floating nature of the shoe 46 also assists in this function in preventing the "spearing" of trailing rear flaps which has been a continuous problem in the prior art.

Figure 8:
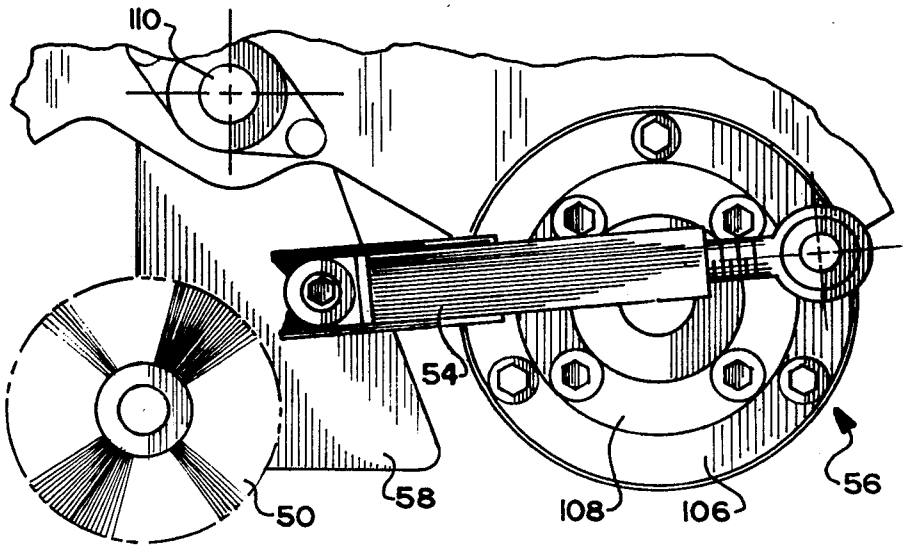
FIG. 8 is a front elevational view of the rear flap opener of the invention and the adjustment device for the timing of both the front and rear flap opening devices.

With reference now to FIG. 8, the details of the adjusting hub 56 and the interconnection with the tracking arm 58 may be seen. As discussed above, the adjusting hub 56 interconnects with the shaft which drives the wheel 60. Similarly, via the crank arm 54, the adjusting hub 56 interconnects with and controls the motion of the arm 58 and brush 50. The adjusting hub 56 basically comprises two concentric hubs 106,108. The outer hub 106 may be loosened and rotated to obtain the proper timing of the rear flap opening brush 50 by changing the position of the crank arm 54 with respect to the wheel 60. The inner hub 108, connected to the shaft received by opening 96 in wheel 60, may be loosened and rotated, thus rotating the wheel 60, to achieve proper spacing and timing of the front flap opening brush 52. It will be appreciated that the hubs 106,108 are flared or of a cone-shaped nature such that as they are tightened down, they operate in unison. Hub 106 is rigidly attached to a thrushaft which is keyed to wheel 60 as at 96. This thrustshaft is coaxially received within a driving shaft. The four bolt pattern of hub 108 effects a tapered collar which, in turn, causes hub 108 to operate in unison with the coaxial driving shaft. The hub 106 is then tightened against the outer diameter of the hub 108 to cause both hubs 106,108 and the coaxial shafts to operate in unison. It will also be noted in FIG. 8 that the arm 58 pivots about the bearing 110.

It should now be appreciated from FIG. 8 that the concentric hubs 106,108 of the adjustment hub 56 allow an operator to adjust the spacing of the engagement and operation of the brushes 50,52. Accordingly, various lengths of cases 76 with various flap sizes may be accommodated. Similarly, the case guides 15 are of adjustable spacing width-wise, to allow for the accommodation of various widths of cases 76, such adjustment now being known in the art. Finally, and as discussed above, the head assembly of the flap opener 10 may be raised or lowered with respect to the base via jack screws to accommodate any of numerous cases of varying depths or heights. Accordingly, the flap opener is universal in that it will accommodate a wide range of case sizes.

Figure 9:
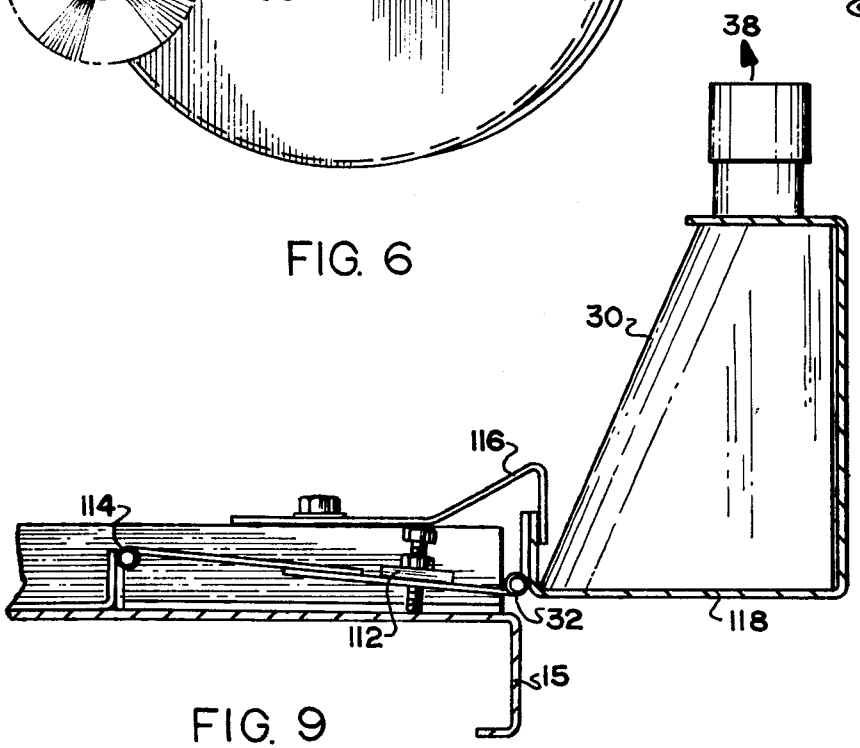
FIG. 9 is a cross-sectional view of the vacuum-actuated side flap opener section of the invention.

With reference now to FIG. 9, the hinged connection of the vacuum shoes 30 may be seen. It will be noted that the shoes 30 are hinged as at 32, and are adjustable as to their alignment with the top surface of the case guide 15 by means of an adjustment bolt 112. The adjustment bolt 112 allows the elevation or angle of the bottom surface 118 of the flap opener to be adjusted to accommodate the flaps of the incoming cases. This adjustment is facilitated by means of the hinge 114. It will finally be noted that a retaining finger 116 restricts the movement of the shoes 30 such that the hinge 32 acts as a one-way hinge, only allowing the shoes 30 to lift upwardly. It should, of course, be appreciated that there is a slot provided in the bottom surface 118 of the shoes 30, which slot communicates a vacuum to the incoming side flaps. When the vacuum "mates" with the flaps, the collapsible hose 30 collapses to lift the shoes 30 via the hinge 32 toward the vacuum source, thus opening the side flaps as discussed above.

Thus it can be seen that the objects of the invention have been obtained by the structure presented hereinabove. While in accordance with the patent statutes only the best mode and preferred embodiment of the invention has been presented and described in detail, it will be understood that the invention is not limited thereto or thereby. Accordingly, for an appreciation of the true scope and breadth of the invention, reference should be had to the appended claims.

What is claimed is:

1. A flap opener, comprising:

an input conveyor;

a pair of vacuum-actuated side flap openers positioned along said conveyor;

a side flap spreader positioned along said conveyor after said vacuum-actuated side flap openers;

a pair of brushes in common driven interconnection, rotatably maintained above said conveyor beyond said spreader, said brushes adapted for opening engagement with front and rear flaps of a container; and wherein said brushes rotate about parallel axes, in opposite directions, said brushes being driven by a common shaft in adjustable spaced relationship with respect to each other, at least one of said brushes being connected to an adjustable hub on said shaft via a crank arm.

2. The flap opener according to claim 1 wherein said side flap openers comprise plates hingedly attached to each side of said conveyor, each plate having a slot therein in communication with a vacuum source, said plates and slots extending over said conveyor.

3. The flap opener according to claim 2 wherein said vacuum source is connected to said plates through extensible and collapsible hoses.

4. The flap opener according to claim 1 wherein said side flap spreader comprises an inverted plow-shaped member, the point of said member centrally aligned with said conveyor.

5. The flap opener according to claim 4 wherein said plow-shaped member includes a floating shoe at said point, said floating shoe being inclined with respect to said conveyor.

6. The flap opener according to claim 5 wherein said plow-shaped member feeds directly into retaining means for receiving and maintaining the side flaps in a horizontal posture along said conveyor.

7. The flap opener according to claim 1 which further includes a fabric belt loop maintained above said conveyor, beyond said brushes, said belt loop being driven in common with said brushes.

8. The flap opener according to claim 7 which further includes a rear flap hold-down means adjacent said belt loop and rotatable therewith for maintaining said rear flap beneath said fabric belt.

9. The flap opener according to claim 7 wherein said fabric belt loop rotates about a spring-biased pulley.

10. A flap opener, comprising:

an input conveyor;

a pair of vacuum-actuated side flap openers positioned along said conveyor;

a side flap spreader positioned along said conveyor after said vacuum-actuated side flap openers;

a pair of brushes in common driven interconnection, rotatably maintained above said conveyor beyond said spreader, said brushes adapted for opening engagement with front and rear flaps of a container; and a fabric belt loop maintained above said conveyor, beyond said brushes, said belt loop being driven in common with said brushes for engaging and urging the front flap to an open position.

11. The flap opener according to claim 10 which further includes a rear flap hold-down means adjacent said belt loop and rotatable therewith for maintaining said rear flap beneath said fabric belt.

12. The flap opener according to claim 10 wherein said fabric belt loop rotates about a spring-biased pulley.

13. A flap opener, comprising:

an input conveyor;

a pair of vacuum-actuated side flap openers positioned along said conveyor, said side flap openers comprising plates hingedly attached to each side of said conveyor, each plate having a slot therein in communication with a vacuum source, said plates and slots extending over said conveyor in adjustable relation thereto;

a side flap spreader positioned along said conveyor after said vacuum-actuated side flap openers; and a pair of brushes in common driven interconnection, rotatably maintained above said conveyor beyond said spreader, said brushes adapted for opening engagement with front and rear flaps of a container.

14. The flap opener according to claim 17 wherein said vacuum source is connected to said plates through extensible and collapsible hoses.

15. The flap opener according to claim 13 wherein said plates are hingedly connected by a one-way hinge.

16. The flap opener according to claim 15 which further includes an adjustment bolt in communication with each said hinge for establishing an angle at which each said plate is maintained with respect to said conveyor.

* * * * *